US006539686B1

(12) United States Patent
Trebbi

(10) Patent No.: US 6,539,686 B1
(45) Date of Patent: Apr. 1, 2003

(54) DEVICE FOR FEEDING HARD-GELATIN CAPSULES TO A CAPPING MACHINE

(75) Inventor: Roberto Trebbi, San Lazzaro di Savena (IT)

(73) Assignee: I.M.A. Industria Macchine Automatiche S.p.A., Bologna (IT)

( * ) Notice: Subject to any disclaimer, the term of this patent is extended or adjusted under 35 U.S.C. 154(b) by 27 days.

(21) Appl. No.: 09/868,772

(22) PCT Filed: Oct. 12, 2000

(86) PCT No.: PCT/EP00/10048

§ 371 (c)(1),
(2), (4) Date: Jun. 21, 2001

(87) PCT Pub. No.: WO01/37777

PCT Pub. Date: May 31, 2001

(30) Foreign Application Priority Data

Nov. 24, 1999 (IT) ..... B099A0632

(51) Int. Cl.[7] ..... B65B 57/00
(52) U.S. Cl. ..... 53/53; 53/900
(58) Field of Search ..... 53/281, 53, 54, 53/900

(56) References Cited

U.S. PATENT DOCUMENTS

| | | | | |
|---|---|---|---|---|
| 1,545,777 A | * | 7/1925 | Kath et al. | 53/900 |
| 1,839,820 A | * | 1/1932 | Wilkie | 53/281 |
| 2,412,637 A | * | 12/1946 | Smith | 53/281 |
| 3,831,476 A | * | 8/1974 | Noren et al. | 53/900 |
| 4,089,152 A | * | 5/1978 | Zanasi | 53/281 |
| 5,417,030 A | * | 5/1995 | Ribani et al. | 53/281 |
| 5,966,910 A | * | 10/1999 | Ribani et al. | 53/900 |

FOREIGN PATENT DOCUMENTS

| | | | |
|---|---|---|---|
| EP | 615739 A1 | * | 9/1994 |
| NL | 8401800 A | * | 1/1986 |

* cited by examiner

*Primary Examiner*—Ted Kavanaugh
(74) *Attorney, Agent, or Firm*—Larson & Taylor PLC

(57) ABSTRACT

Respective secondary thrusters (70, 71) are added to the primary horizontal thruster (7) and primary vertical thruster (12) of a guiding device of the known type and the guide channel (6) is provided with dimensions such that the steps of guiding and feeding the capsule (C) are performed with minor successive displacements of the said capsule (C). The primary vertical thruster (12) operates, in a position distant from the sleeve (13) of the capping machine so as to allow discarding and free removal of the defective capsules (C) which have a double lid (C2) or the capsule parts which reach this thruster. The last section (206) of the guide channel (6) inside which the secondary vertical thruster (71) operates, has a width slightly smaller than that of the upstream section (106) of the said channel so as to retain firmly the end of the defective capsule (C) having lids (C2) on opposite ends of a base (C1). Such a defective capsule (C), which is arranged horizontally or inclined by the primary horizontal thruster (7), is then acted on by the tip (112) of the primary vertical thruster (12) and by a face (171) of the secondary vertical thruster (71) which discard this defective capsule (C) from the bottom of the guide channel (6). On the other hand, a capsule (C) correctly fitted with a lid (C2) and oriented vertically by the primary vertical thruster (12) remains inside the guide channel (6), is then displaced inside the latter by the secondary horizontal thruster (70) and then a leading face (271) of the secondary vertical thruster (71) acts on this capsule and accompanies the said capsule (C) during the complete stroke for insertion inside the sleeve (13) of the capping machine.

5 Claims, 3 Drawing Sheets

DEVICE FOR FEEDING HARD-GELATIN CAPSULES TO A CAPPING MACHINE

DESCRIPTION

The invention is applied industrially in the sector of pharmaceutical machines known as capping machines operating intermittently or continuously and designed to open, fill and close hard-gelatin capsules which are fed pre-closed to said machines. In particular, the invention refers to the devices which feed the capsules into the seats or sleeves of the capping machines. FIGS. 1 and 2 in the accompanying drawings show, with parts sectioned and in different operating conditions, a side elevation view of a known device for feeding the capsules to the sleeves of a capping machine. From the said figures it can be seen that the hard-gelatin capsules C are provided with a bottom cap or base C1 with a rounded end, onto which a covering cap or lid C2 with a rounded end is fitted. The external diameter of the base C1 is usually less than the external diameter of the lid C2. The empty and pre-closed capsules C are placed randomly inside a hopper—not shown—inside which a hollow and vertical tube 1 enters at the bottom and moves axially with an alternating movement, the internal diameter of said tube being slightly greater than the external diameter of the lid C2 of the capsules C such that the latter enter into the tube in succession, vertically arranged and randomly oriented. An intercepting element 2 is laterally hinged on the tube 1 at the pivot 3 and, via spring means (not shown), is normally kept in the active position for retaining the capsules C inside the tube 1 when the latter is raised as shown in FIG. 2 and which, when instead the same tube 1 is lowered as shown in FIG. 1, interferes with stopping means 4 and retracts so as to allow a capsule C to fall into a calibrated well 5 where the said capsule C remains in a vertical position resting on the bottom 105 of said well. The well 5 is located in the middle part of a horizontal, straight and flat channel 6, an end section 106 of which has a width slightly smaller than the external diameter of the lid C2 of the capsules C, while in the section at the opposite end of the same channel 6 there slides a horizontal thruster 7 provided on its face directed towards the well 5 with a tip 107 located about halfway up the height of this well 5. The thruster 7 is for example hinged at 10*b*, via a connecting rod 8, with an angled lever 9 which is pivotably mounted in between at 10 on a fixed support 11 and hinged at 10*a* with the slide 101 which supports the tube 1 and from which the said thruster 7 derives the movement which causes it to move to the right when the tube 1 is raised as shown in FIG. 2 and instead causes it to return into the rest position as can be seen in FIG. 1, when the said tube 1 is lowered. During operation of the apparatus, when the thruster 7 moves to the right, its tip 107 touches, in the middle part, the capsule C located inside the well 5 and pushes it into the section 106. If the capsule C is oriented with its base C1 upwards, the tip 107 and the friction of the channel section 106 against the lid C2 have the effect that the said capsule C follows the movement of the thruster 7, rotating in an anti-clockwise direction when viewing FIG. 1, until it reaches the position shown in continuous lines and indicated by C' in FIG. 2. If, on the other hand, the capsule C is oriented inside the well 5 with its lid C2 downwards, the said capsule C follows the movement of the thruster 7 and at the same time rotates in the clockwise direction when viewing FIG. 1 and reaches the position shown in broken lines and indicated by C" in FIG. 2. In either case, after the active stroke of the thruster 7, the capsule C reaches the end part of the section 106 of the channel 6, arranged substantially horizontally and with the lid C2 again directed to the left when viewing FIG. 2. From FIGS. 1 and 2 it can be seen that the tube 1 has, associated with it, a vertical thruster 12 with a tip 112 directed towards the middle part of the capsules in the positions C' or C", so that when the horizontal thruster 7 returns into the rest position after lowering of the tube 1, the vertical thruster 12 pushes the capsule C downwards and at the same time causes it to rotate clockwise when viewing FIG. 1, again owing to the friction exerted by the section 106 of the channel 6 on the lid C2 of the said capsule C, until the said capsule C mates with the rounded recess 212 in the thruster 12 and is arranged vertically with the lid C2 upwards and the base C1 downwards. In this condition the capsule is made to leave the bottom part of the section 106 of the channel 6 and fall into the sleeve 13 of one of the radial slides S of the capping machine carousel, the sleeve 13 being shaped so as to retain the capsule by means of the step formed by the edge of the lid C2.

At present, in the known devices of the type described above, owing to the relative movements which the capsules C undergo during storage, transportation and introduction into the said feeding hopper, and also owing to the alternating movement of the tube 1 inside said hopper, a capsule C may open and the well 5, instead of receiving a capsule C together with its associated lid C2 directed downwards or upwards, may receive only the base C1 of a capsule C or else a capsule C which below will be described by the term "defective capsule" and which has two lids C2 on one end or on the opposite ends of a base C1. In such cases, the base or the defective capsule with the two lids C2 are transferred by the horizontal thruster 7 above the sleeve 13 so that only the base C1 is able to fall by means of gravity inside the sleeve 13, or the subsequent intervention of the vertical thruster 12 may insert the defective capsule C with the two lids C2 into the sleeve 13, consequently obstructing the said sleeve 13 and in certain cases causing blockage of the capping machine.

The invention intends to overcome the said drawback and limitation of the known art with the following proposed solution. Respective secondary thrusters are added to the horizontal and vertical thrusters or primary thrusters and the guide channel is provided with dimensions such that the capsule guiding and feeding steps are performed with minor successive displacements of the said capsule. For this purpose the primary vertical thruster is made to operate in a position distant from the capping machine sleeve, i.e. at a distance such as to allow discarding and removal of the defective capsules with a double base or the individual bases of the said capsules. The portion of the guide channel section inside which the secondary vertical thruster operates is provided with dimensions such that it has a width slightly less than that of the upstream portion of the said channel section in order to retain firmly the ends of any defective capsules which have lids on the opposite ends of a base. Such a defective capsule, arranged horizontally or inclined by the primary horizontal thruster, is then acted on both by the tip of the primary vertical thruster and by a front and rear face of the secondary vertical thruster able to expel this defective capsule from the bottom of the guide channel.

Further characteristic features of the invention and the advantages arising therefrom will emerge more clearly from the following description of a preferred embodiment thereof, illustrated purely by way of non-limiting example in the figures of the attached sheets of drawings, in which.

Figure 2:
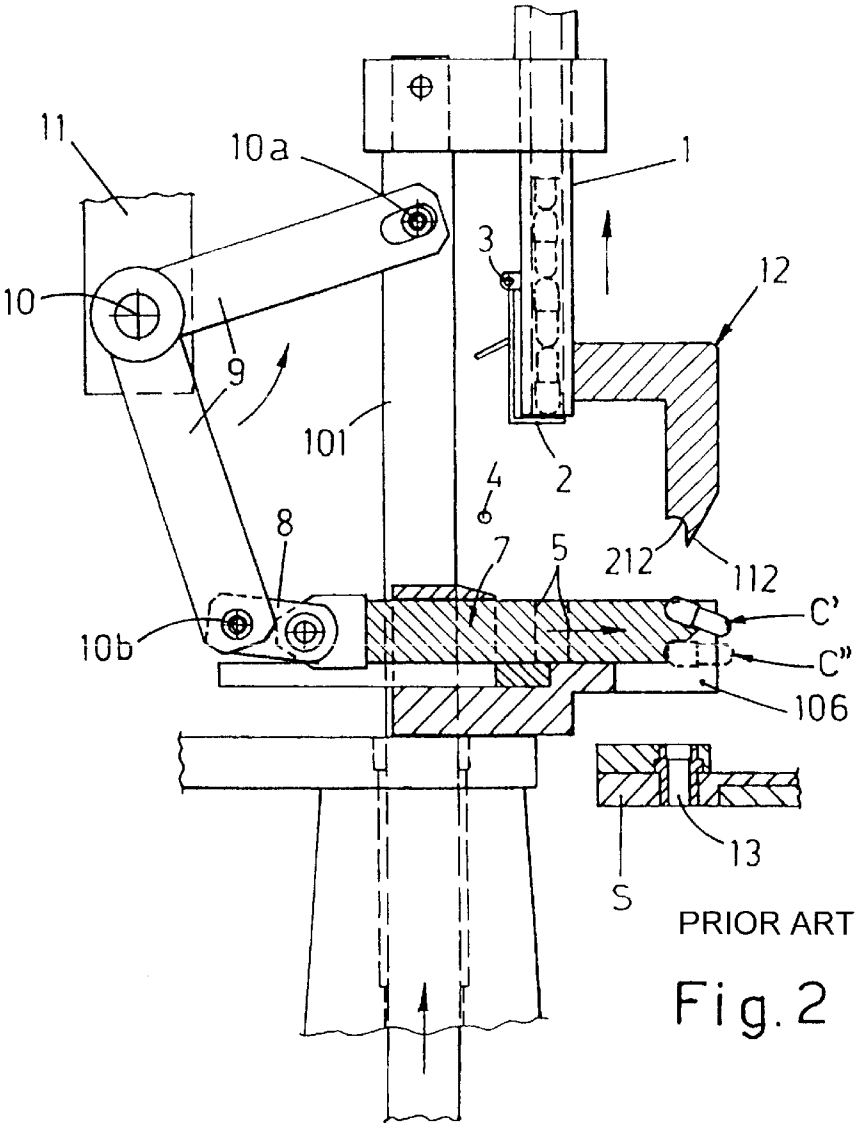
PRIOR ART Fig. 2
FIGS. 1 and 2 are side views, with parts sectioned, of the known guiding and feeding device described in the introduction of the present description and shown during successive working stages.
Figure 1:
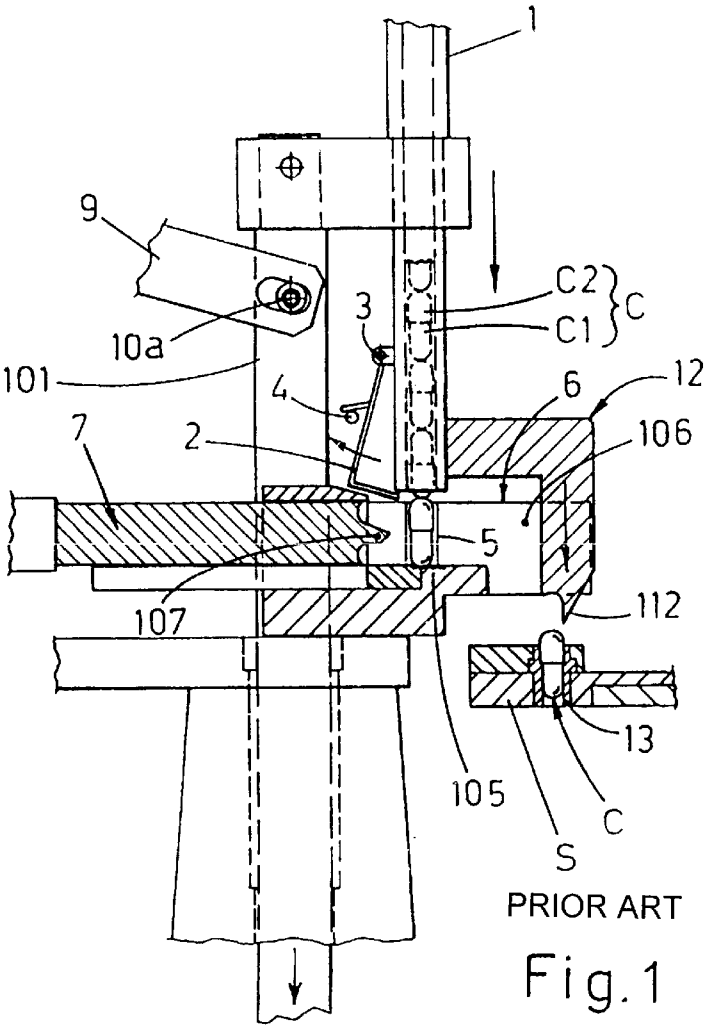
PRIOR ART Fig. 1
Figure 4:
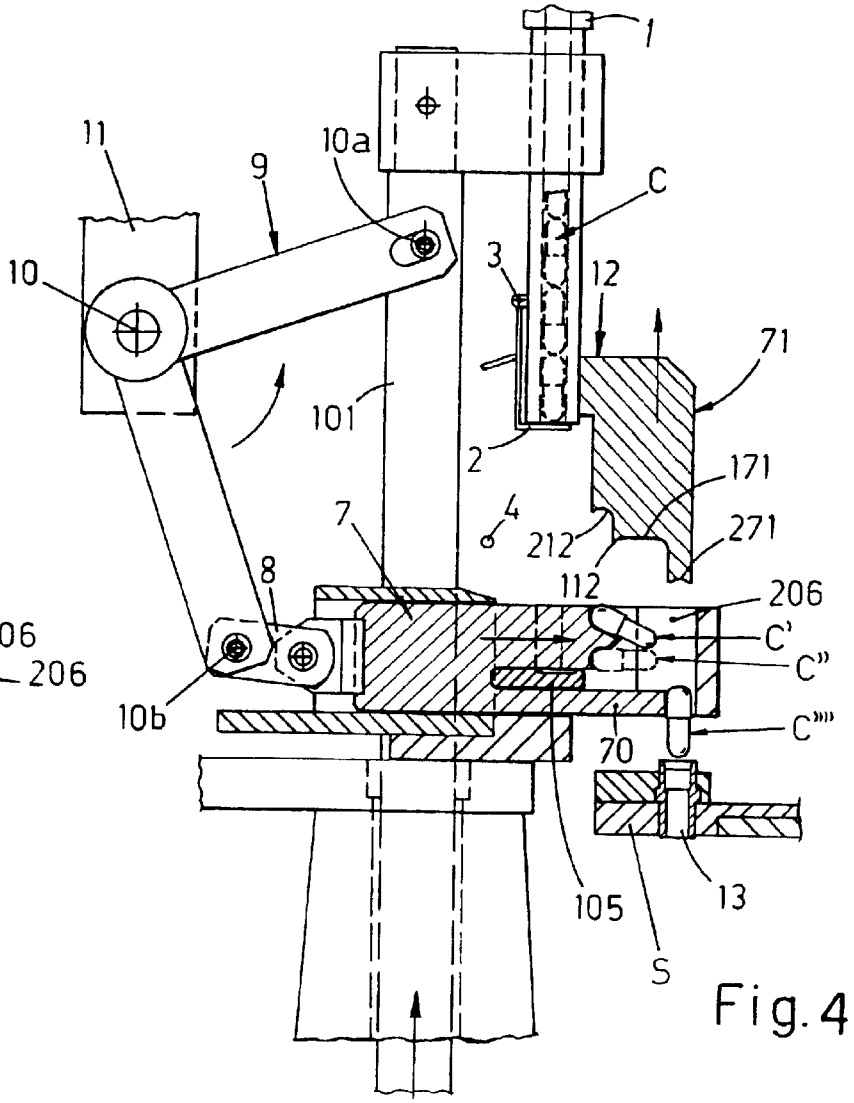
FIGS. 3 and 4 are side views, with parts sectioned, of the improved device according to the invention shown in the different end-of-travel positions of the thrusters.
Figure 3:
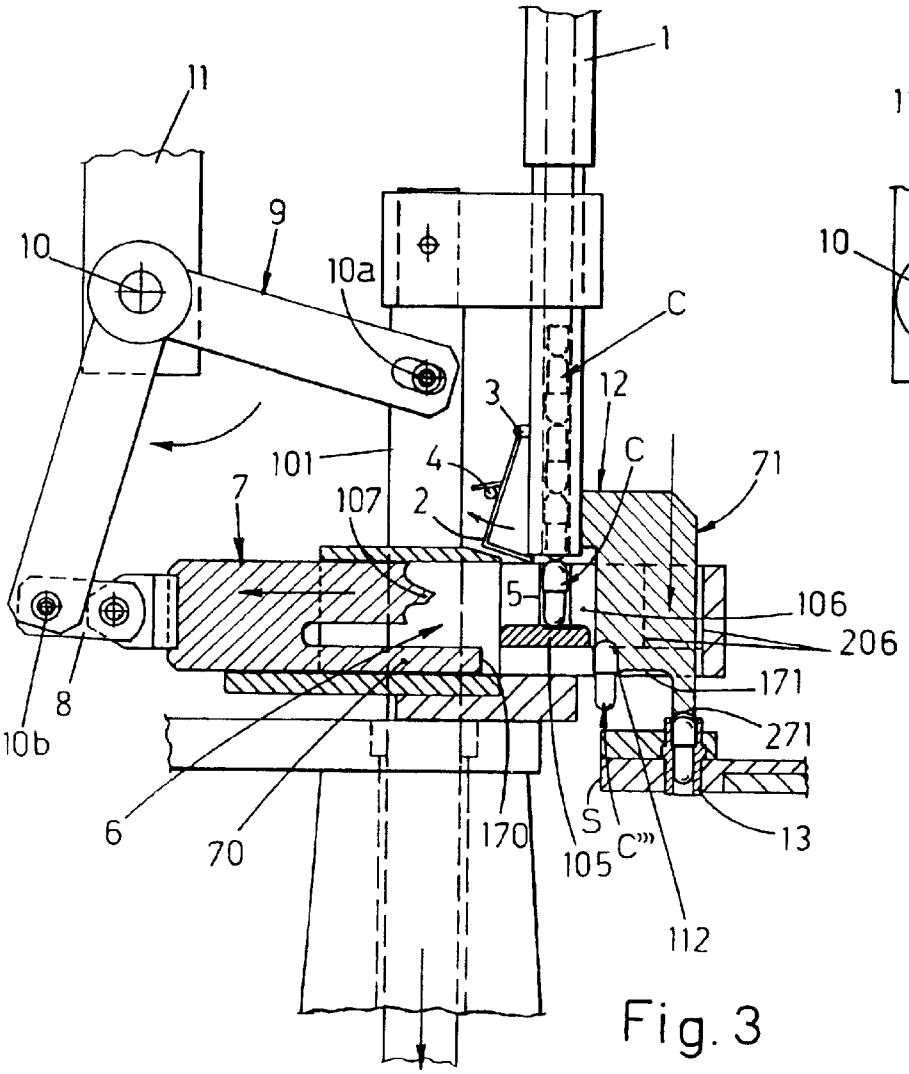
Figure 5:
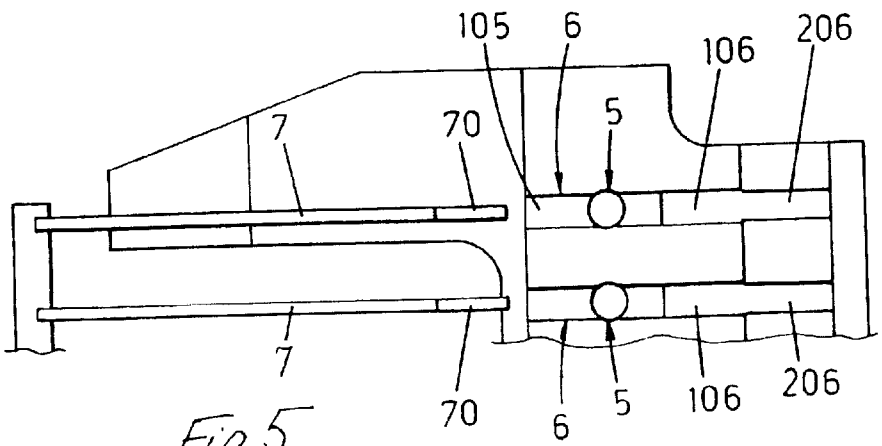
FIG. 5 is a schematic, partial, top plan view of one of the devices in question.

From FIGS. 3 and 4 it can be seen that a secondary horizontal thruster 70 is now associated at the bottom of the primary horizontal thruster 7, of the type considered with reference to FIGS. 1 and 2, the front face 170 of the former being vertical and flat or slightly curved so as to match the rounded shape of the capsule C with which it comes into contact and being located suitably in advance of the tip 107 of the said primary thruster 7. The secondary thruster 70 operates below the well 5 which is closed at the bottom by the bottom or baffle 105. The guide channel 6 is now provided with dimensions such as to retain the capsules C moved by both the thrusters 7 and 70, as will be explained further below. From the detail shown in FIG. 5 it can be seen that the section 106 of the channel 6 guiding the capsules C extends lengthwise beyond the primary vertical thruster 12 with a, portion 206 having a width equal to that of the said section 106 or preferably a slightly smaller width. A secondary vertical thruster 71 associated with the primary vertical thruster 12, the tip 112 of which is now shorter than that of the vertical thruster of the known type (FIGS. 1 and 2), operates above the guide channel section 206 (FIGS. 3, 4). The front face of the secondary thruster 71 has a stepped configuration and has a first substantially horizontal set-back section 171 having a length slightly less than that of a capsule and located slightly above the tip 112, and has a second advanced section 271 with a width approximately equal to that of a capsule and characterized by a small concavity directed downwards. The face 171 is located at a distance from the face 271 greater than the thickness of a capsule C.

The apparatus thus designed operates in the manner described below. If the capsule C introduced from the tube 1 into the well 5 is normally closed and has its lid C2 directed upwards or downwards, after the stroke of the primary horizontal thruster 7 the said capsule C will reach, respectively, the position indicated by C' or C" in FIG. 4, always with the lid C2 making contact with the said thruster 7. During the subsequent return stroke of the horizontal thruster 7, the tip 112 of the primary vertical thruster 12 comes into contact with the lid C2 of the capsule C in one of the said positions and causes the said capsule C to rotate clockwise when viewing FIG. 4, until the same capsule C is arranged vertically and is inserted with the lid C2 into the recess 212. At the end of the active stroke of the primary vertical thruster 12, the capsule C reaches the position indicated by C'" in FIG. 3. During the subsequent raising stroke of the vertical thrusters 12, 71, while the primary horizontal thruster 7 acts on a new capsule, the secondary horizontal thruster 7O touches the lid C2 of the capsule C in the said position C'" and displaces it horizontally into the position C"" indicated in FIG. 4, where the said capsule C is aligned with the sleeve 13 of the slide S. During the subsequent operating stroke of the vertical thrusters 12, 71, the capsule in position C"" is inserted into the sleeve 13 by the leading face 271 of the secondary vertical thruster 71, which accompanies the said capsule C during the whole stroke where it is introduced into the said sleeve 13, as illustrated in FIG. 4.

Figure 7:
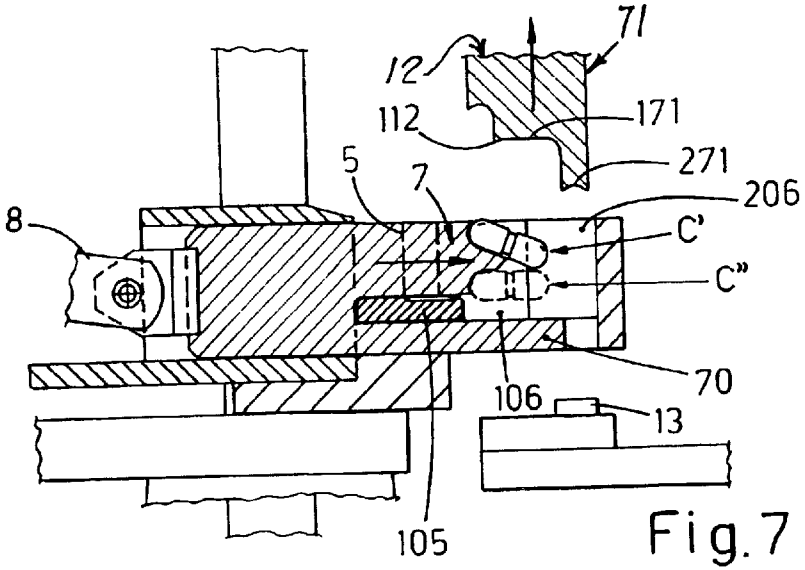
FIGS. 6, 7 and 8 show the device in question laterally, with parts sectioned, during successive operations involving a capsule with a double lid.
Figure 6:
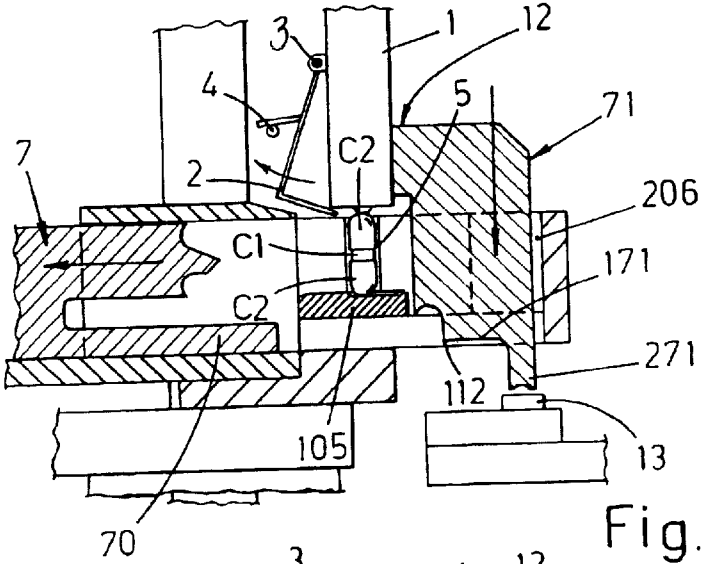
Figure 8:
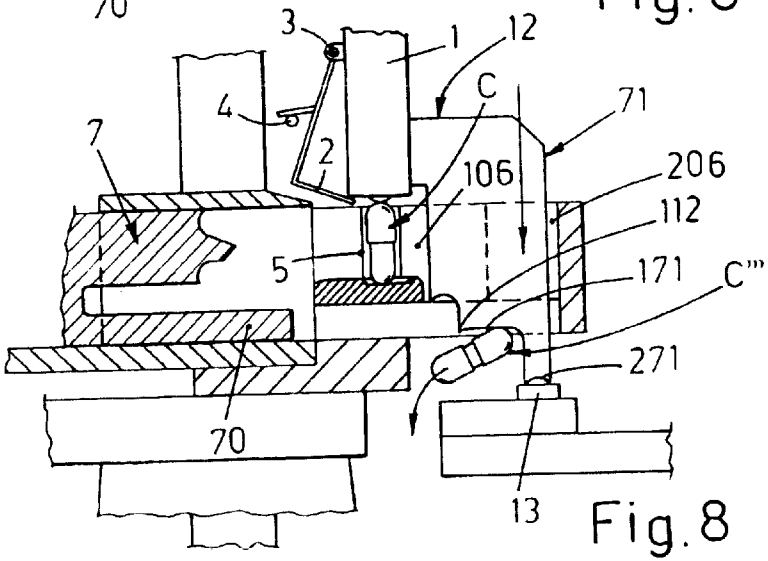

If a defective capsule C reaches the well 5, with two lids C2 mounted on the opposite ends of a base C1, as illustrated in FIG. 6, after the active stroke of the main horizontal thruster 7, the said defective capsule C is transferred into the position indicated for example by C' or C" in FIG. 7, with one of the lids C2 inside the end part 206 of the channel 6 which, being slightly narrower than the section 106 of the said channel, ensures stable mating of the lids C2 with the base C1 of the capsule C, so as to ensure subsequent complete elimination of the defective capsule C. In fact, when the primary vertical thruster 12 intervenes, its tip 112 touches the middle part of the capsule C which is stationary at C' or C" and causes it to rotate anti-clockwise since the said capsule C is retained mainly by the channel end section 206. The defective capsule C fitted with two lids C2 is arranged in contact with the tip 112 and with the front face 171 of the secondary vertical thruster 71 and, during the downwards movement of this secondary thruster, the, said defective capsule is expelled from the bottom part of the section 106 of the guide channel 6, as illustrated in FIG. 8.

If, on the other hand, only the base C1 of a capsule C reaches the well 5, said base falls from the bottom of the guide channel 6 after the active stroke of the primary horizontal thruster 7, as in the known art, with the difference that now the base C1 falls initially onto the secondary horizontal thruster 70 and, when the latter retracts, the said base C1 interferes with the baffle 105 and leaves, by means of gravity, the guide channel 6 in a position far from the sleeve 13.

If, on the other hand, a defective capsule C reaches the well 5 with two lids C2 inserted inside one another on a base C1, it may happen that the two lids C2 are directed upwards or downwards. In the first case the additional lid C2, or the outer lid C2, is retained by the device 2 for intercepting the tube 1. If, on the other hand, the two lids C2 are directed downwards, the capsule C provided with a single lid C2 is retained by the device 2 of the tube 1 and only the outer lid C2 remains inside the well 5 and, owing to the action of the various primary and secondary thrusters, is able to follow the path of a defect-free capsule and reach the sleeve 13 of the capping machine. By means of sensors applied to the known suction devices designed to open the capsules C in the capping machine, it is possible to detect that there is only one lid C2 inside the sleeve 13 and transmit the information to the electronic control processor of the machine which will ensure that the missing capsule is not filled, while the lid C2 will be eliminated during the final sleeve-cleaning stage.

Finally, special means, not shown, are provided for removing from the capping machine, and collecting, the capsule rejects discarded from the bottom of the guide channel 6.

A further advantage resulting from the device according to the invention consists in the fact that the secondary vertical thruster 71, with its leading face 271, accompanies the capsule C during the whole of the insertion stroke inside the sleeve 13 of the capping machine, ensuring correct introduction thereof. In the known devices, on the other hand, as shown in FIG. 1, the vertical thruster 12 abandons in advance the capsule which is discarded from the guide channel 6, which enters the sleeve 13 only by means of gravity.

What is claimed is:

1. A device for feeding hard-gelatin capsules to a capping machine where each capsule has a larger lid in which a smaller base is received, said device comprising:

a tube in which pre-formed capsules are (a) arranged vertically with a random arrangement of smaller bases and larger lids of each capsule lowermost and (b) individually dispensed from an end of said tube;

a horizontal guide channel which is sized to slidably hold the larger lid of a capsule, said guide channel including a central well located below the end of said tube and into which said well an individually dispensed capsule is vertically dispensed from said tube;

a primary horizontal thruster which is movable horizontally inside of said horizontal guide channel with a forward and a return movement, said primary horizontal thruster including a horizontal tip which engages a middle of the capsule located vertically in said well such that upon completion of the forward movement of said primary horizontal thruster the capsule is held by the larger lid in a displaced position in said horizontal guide channel with the smaller base directed forwards;

a primary vertical thruster which is which is movable vertically inside of said horizontal guide channel with a downward and a return movement, said primary vertical thruster including a vertical tip which engages, after said primary horizontal thruster has commenced the return movement, the larger lid of the capsule located in the displaced position such that upon completion of the downward movement of said primary vertical thruster the capsule is held by the larger lid in a lowered position in said horizontal guide channel with the smaller base directed downwards;

a secondary horizontal thruster associated with said primary horizontal thruster for complementary movement therewith, said secondary horizontal thruster including a horizontal front face which (a) is located below said horizontal tip of said primary horizontal thruster and (b) moves horizontally in advance of said horizontal tip during the forward movement of said primary horizontal thruster to engage the larger lid of the capsule located in the lowered position such that upon completion of the forward movement of said primary horizontal thruster the capsule is held by the larger lid in a dispensing position in said horizontal guide channel with the smaller base directed downwards; and a secondary vertical thruster associated with said primary vertical thruster for complementary movement therewith, said secondary vertical thruster including (a) a first vertical front face which is located below said vertical tip of said primary horizontal thruster and which moves vertically during the downward movement of said primary vertical thruster to engage the larger lid of the capsule located in the dispensing position and to move the capsule in the dispensing position downward out of said horizontal guide channel and into a complementary receiving sleeve of the capping machine, and (b) a second vertical front face located adjacent said vertical tip such that, if the capsule is defective and includes a second large lid located on a closed end of the smaller base whereby the defective capsule has still been moved by said primary horizontal thruster to the displaced position but not necessarily with the smaller base directed forwards, as said vertical tip engages one of the larger lids of the defective capsule located in the displaced position upon completion of the downward movement of said primary vertical thruster the defective capsule is expelled by said second vertical front face out of said horizontal guide channel.

2. A device for feeding hard-gelatin capsules to a capping machine as claimed in claim 1, wherein the first vertical front face has a concave shape which matches a rounded closed end of the larger lid of the capsule.

3. A device for feeding hard-gelatin capsules to a capping machine as claimed in claim 1, wherein said second vertical front face has a horizontal width which is less than a length of the capsule.

4. A device for feeding hard-gelatin capsules to a capping machine as claimed in claim 1, wherein said first vertical front face is located at a distance from said second vertical front face which is slightly greater than a thickness of the capsule.

5. A device for feeding hard-gelatin capsules to a capping machine as claimed in claim 1, wherein said horizontal guide channel includes (a) a main portion which has a width sized to slidably hold the larger lid of the capsule and (b) an end section in which said secondary vertical thruster moves and which has a width which is slightly smaller than that of said main portion, such that upon completion of the forward movement of said primary horizontal thruster which moves the defective capsule to the displaced position, the larger lid of the defective capsule which is forward most is engaged in said end section whereby the defective capsule has been subjected to an axial compression by said primary horizontal thruster to assure that both larger lids are positively retained on the smaller base.

* * * * *